US005954137A

United States Patent [19]

Coronado et al.

[11] Patent Number: 5,954,137

[45] Date of Patent: Sep. 21, 1999

[54] APPARATUS AND METHOD FOR AVOIDING FORMATION IMPAIRMENT DURING COMPLETION OF WELLBORES

[75] Inventors: Martin Coronado, Cypress; Peter Fontana, Houston, both of Tex.; Allan Mackenzie, Muscat, Oman

[73] Assignee: Baker Hughes Incorporated, Houston, Tex.

[21] Appl. No.: 08/947,557

[22] Filed: Oct. 9, 1997

Related U.S. Application Data

[63] Continuation-in-part of application No. 08/555,598, Nov. 9, 1995, Pat. No. 5,749,419

[60] Provisional application No. 60/027,927, Oct. 9, 1996.

[51] Int. Cl.[6] ..... E21B 33/12

[52] U.S. Cl. ..... 166/387; 166/187; 166/321; 166/120; 166/134; 166/151; 166/188; 166/194

[58] Field of Search ..... 166/386, 387, 166/134, 151, 187, 188, 192, 194, 321

[56] References Cited

U.S. PATENT DOCUMENTS

| | | | |
|---|---|---|---|
| 2,781,854 | 2/1957 | Boer et al. | 166/187 |
| 2,791,278 | 5/1957 | Clark, Jr. et al. | 166/204 |
| 3,035,639 | 6/1962 | Brown et al. | 166/150 |
| 3,830,296 | 8/1974 | Shirley | 166/191 |
| 3,884,261 | 5/1975 | Clynch | 137/488 |
| 4,133,386 | 1/1979 | Knox | 166/285 |
| 4,224,987 | 9/1980 | Allen | 166/120 |
| 4,345,649 | 8/1982 | Baugh et al. | 166/120 |
| 4,796,707 | 1/1989 | Halbardier | 166/387 |
| 5,184,677 | 2/1993 | Dobscha et al. | 166/187 |
| 5,226,485 | 7/1993 | Dobscha et al. | 166/187 X |

FOREIGN PATENT DOCUMENTS

WO 93/13293 7/1993 WIPO .

*Primary Examiner*—Roger Schoeppel
*Attorney, Agent, or Firm*—Madan & Morris, PC

[57] ABSTRACT

Completion method for avoiding formation impairment in the completion of a wellbore by anchoring and activating a plug at a selected position in the wellbore to seal off a selected portion of the wellbore from other portions of the wellbore. The plug is positioned at the selected position in the wellbore and anchored at that position. A seal in the plug is then activated such that fluid cannot pass the plug. Other parts of the wellbore can then be operated at different pressures than the isolated part of the wellbore without impairment of the formation resulting from the loss of well fluids into the formation.

23 Claims, 10 Drawing Sheets

P
22
50
52
36
10
11
78
158
154
156
155
90
92
74
72
94
58
54
56
52
96
98
94
60
70
100
102
68
76
80
157
82
84
66
86
88
186
188
114
64
62
108
106
130
132
116
128
118
104
165
122

199
18
142
36
52
140
142
58
54
52
94
174
144
176
180
146
138
155
154
157
158
156
80
82
84
60
188
160
164
162
186
188
86
138
88
114
178
62
60
116
172
170
118
122
165
126
166
168

APPARATUS AND METHOD FOR AVOIDING FORMATION IMPAIRMENT DURING COMPLETION OF WELLBORES

CROSS-REFERENCE TO RELATED APPLICATIONS

This application takes the benefit of the filing date of U.S. patent application Ser. No. 60/027,927, filed Oct. 9, 1996 and further is a continuation-in-part of copending U.S. patent application Ser. No. 08/555,598, filed on Nov. 9, 1995 now U.S. Pat. No. 5,749,419.

BACKGROUND OF THE INVENTION

1. Field of the Invention

The field of this invention relates to techniques for well completions and more particularly to the use of plugs during underbalanced well completions.

2. Background of the Prior Art

One of the primary goals during drilling and completion operations of wells is to protect the producing formations from damaging effects associated with fluids lost into the formation during the drilling and completion operations. A secondary goal is to eliminate excessive losses of expensive drilling and completion fluids.

Most wells currently are completed conventionally using kill-weight fluids which might impair the formation. Even if a well is drilled underbalanced (formation pressure greater than wellbore pressure), the well typically is exposed to damaging fluids during completion operations. This process defeats the principle purpose of underbalanced drilling which is to avoid impairment of the formation.

In situations using prior art apparatus and techniques, particularly those involving deviated wellbores, the initial portion of the well is drilled and a casing is set. The casing is then cemented. After the cement sets, the deviated portion of the wellbore is drilled. Prior designs have involved running a liner string into the wellbore after completion of the drilling of the deviation in the wellbore beyond the cemented casing. An inflatable packer has been inserted through the liner string to isolate the formation while the bottomhole assembly is assembled into the wellbore above an inflatable bridge plug. Certain problems, however, have developed in particular applications with the use of through-tubing inflatable bridge plugs. For one thing, the ability of the through-tubing inflatables to hold particular differentials can be problematic, especially if there are irregularities in the sealing surface where the plug is inflated. Additionally, due to the compact design required in certain applications, the through-tubing inflatable element cannot expand far enough to reliably hold the necessary differential pressures that might exist across the inflated bridge plug. Finally, there could also be difficulties in retrieval of the through-tubing inflatable bridge plug back through the string from which it was delivered.

The flexible nature of the through-tubing inflatable design could also create problems if it was decided simply not to retrieve the plug after putting together the bottomhole assembly above it. The slender design of the through-tubing inflatable plug could create advancement problems if the plug were to be merely pushed to the bottom of the hole with the production tubing. If any washouts in the deviated portion of the wellbore were encountered by the bottomhole assembly with the deflated through-tubing plug at the front, then the entire assembly might get stuck prior to its being advanced to the bottom of the wellbore for proper positioning. Generally, the through-tubing designs have not provided a circulation passage therethrough to facilitate advancement of a deflated plug into the uncased portion of a wellbore using circulation.

To prevent formation damage and fluid loss and to maximize productivity of a well, the well needs to be drilled and completed underbalanced. The method and apparatus of the present invention address many of the problems associated with conventional completion techniques by providing a downhole tool such as an inflatable bridge plug which can be set at the desired location to isolate a portion of the wellbore. The tool is securely positioned to enable it to withstand substantial differentials. After the tool is positioned, the bottomhole assembly can be put together in the wellbore above the tool where the wellbore is isolated from the producing formation. The invention accomplishes the objective of removing the plugging device from the path by deactivating it and moving it within the wellbore. By carrying the plug with it within the wellbore, the deactivating apparatus gets the benefit of additional structural rigidity which allows it to advance to the bottom of the hole with less chance of hangups in washouts.

Other advantages of the apparatus and method include a physical support (anchor) for the plug to facilitate its being enveloped after it is deactivated. The design also facilities flow of circulation fluid through the deactivation tool and encapsulated plug as it is being moved to the bottom of the hole.

Another embodiment of the present invention is an inflatable swab valve that is installed as a part of the casing. During operation, the swab valve is inflated inwardly to seal the well. The seal is deactivated for later operations and downhole apparatus pass through the cavity formerly occupied by the inflated membranes of the swab valve.

SUMMARY OF THE INVENTION

A completion apparatus and method are illustrated that use a plug in the wellbore to isolate one section of a well from another, such as an open-hole section that has been drilled underbalanced, to safely hold back the formation without impairing it while completion or other equipment is run downhole. One embodiment of the plug works in conjunction with a deactivation tool which can be run on the bottom of a downhole apparatus such as a completion liner. This provides a method to run the downhole apparatus downhole without having to expose the formation to possibly damaging fluids. After the open-hole section is drilled, the plug is run in the hole on coiled tubing and set. Heavy fluids are then circulated above the plug without its being applied to the open-hole formation. The liner for the open-hole section is run in the well with a deflation tool, which ultimately engulfs the deflated plug using the mechanical support associated with the plug to facilitate the enveloping procedure. After envelopment, setdown weight releases the anchor for the plug and the assembly is run in the hole with circulation through the plug to facilitate advancement. A second embodiment of the invention is an inflatable swab valve that is installed in the casing and inflates inwardly to seal off the inside of the well. It can later be deflated to allow the passage of downhole apparatus through the casing.

DETAILED DESCRIPTION OF THE PREFERRED EMBODIMENTS

Figure 2B:
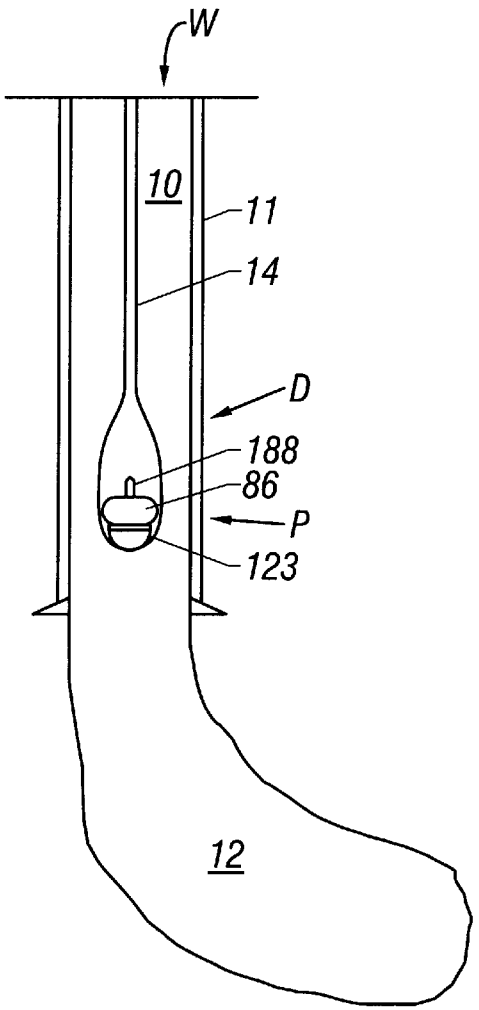
FIG. 2B is the plug of FIG. 1 after it has been deactivated and engulfed by a deactivation tool.
Figure 2A:
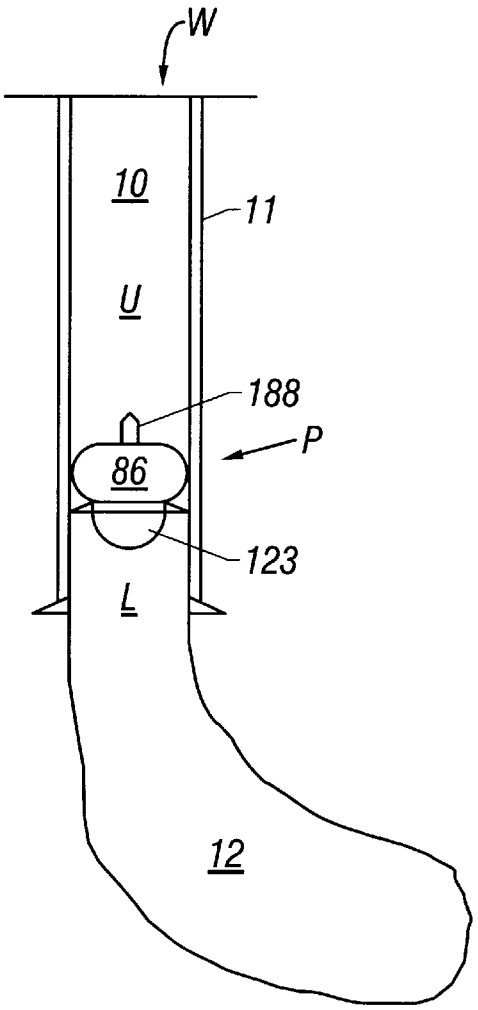
FIG. 2A is the plug of FIG. 1 after it has been set and activated in the wellbore.
Figure 1:
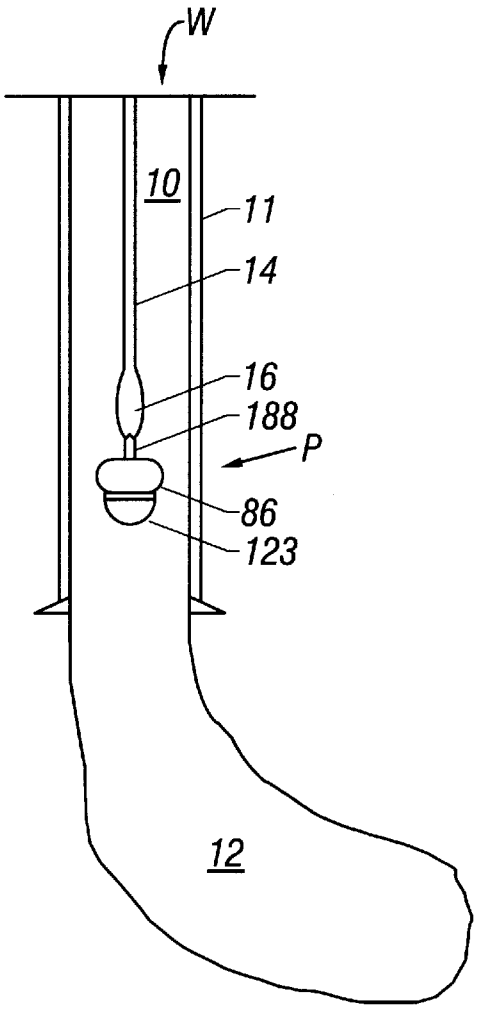
FIG. 1 is a schematic of a plug of the present invention being positioned in the wellbore.

As seen in FIG. 1, a wellbore W is depicted schematically having an upper cased section 10, which has a casing 11 cemented into place prior to drilling an open hole portion 12 of the wellbore W. In FIG. 1 and FIG. 2A–B, the open hole portion 12 is shown as deviated with respect to the cased section 10. Other configurations, however, are also within the purview of the present invention. Coiled tubing 14, with a running tool 16 at its lower end, is used to insert a plug P into the cased section 10 of the wellbore W, as shown in FIG. 1. While the preferred plug P is an inflatable bridge plug, other types of obstruction devices such as packers and swab valves, for example, are intended to be within the scope of the invention.

Upon the setting and activation of the plug P, as shown in FIG. 2A, the wellbore W is divided into two zones, an upper zone U and a lower zone L.

FIG. 2B illustrates the plug P after it has been deactivated and engulfed by a deactivation tool D which has been run downhole on coiled tubing 14. The plug P contains a body 188, an inflatable element 86 and an anchoring mechanism 123 which are described below.

Figure 3:
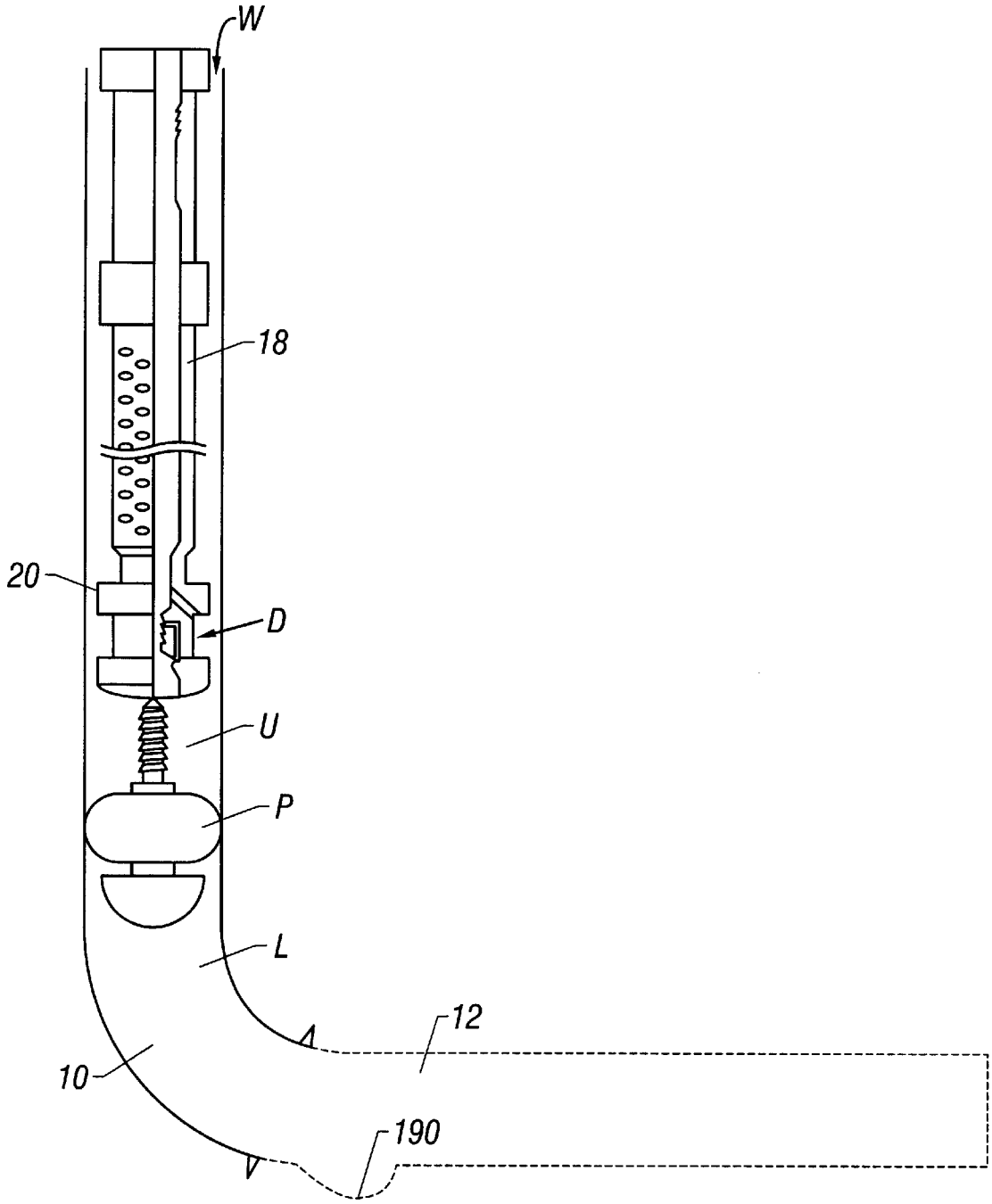
FIG. 3 illustrates the plug of the present invention in use with a completion liner and deflation tool.

FIG. 3 illustrates the plug P in its activated position within the wellbore W. With the plug P activated, other apparatus, such as a completion liner 18 which is also shown in FIG. 3, can be run in the hole without having to kill the well. This avoids the possibility of formation damage due to kill fluids. It should be noted that typically these types of wells have been drilled in an underbalanced state where the wellbore pressure is less than the formation pressure. This is a common technique, particularly with coiled tubing drilling. As shown in FIG. 2A and FIG. 3, the coiled tubing 14 shown in FIG. 1 has been removed and the upper zone U of the wellbore W at this time can be circulated with heavy fluid (not shown) wherein the pressure from that fluid is not applied to the well or lower portion L of the wellbore W due to the presence of plug P in an inflated condition.

FIG. 2B ill shows the plug P in a deflated condition and engulfed by the deflation tool 20, with the entire completion liner 18 (liner assembly) advanced into the open-hole 12 or lower zone L of the wellbore W. The liner assembly 18 attached above the deflation tool 20 does not constitute a portion of this invention and can be any one of a number of different bottomhole configurations for liners being advanced into a wellbore. It is the details of the plug P and the deactivation tool D and how they interact to accomplish the advancement illustrated in FIG. 4 which will be described in FIG. 5(A–D) through FIG. 9(A–D).

Figures 5A, 5B, 5C, 5D:
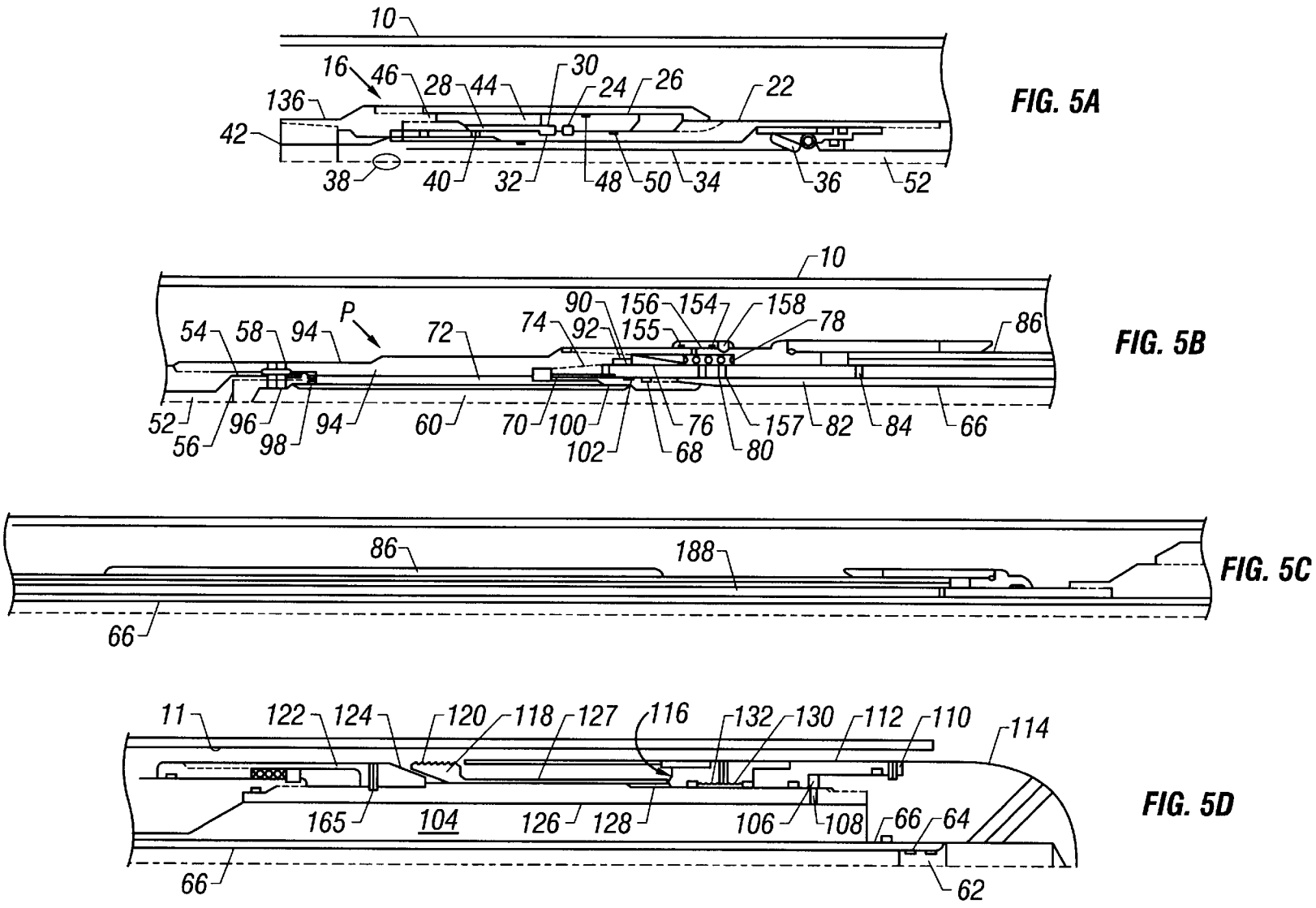
FIGS. 5A–5D show the run-in position for the apparatus and method of the present invention in a sectional elevational view.

FIG. 5(A–D) is a detailed diagram of the running tool 16 which is used in combination with the plug P. The plug P has a latch mandrel 22 (FIG. 5A) which is initially secured to the running tool 16 by virtue of a shear pin 24 extending through a piston 26. One or more collets 28 are part of the running tool 16. The piston 26 has a surface 30 which traps the collets 28 into a groove 32 in the latch mandrel 22. The running tool 16 has a ball sleeve 34 which holds a spring-loaded flapper valve 36 open in the run-in position. Also shown in FIG. 5A is a ball 38 which can engage the ball sleeve 34 in the event emergency release is required as will be explained below. Normal release of the running tool 16 from the latch mandrel 22 occurs through a port 40. Access to the port 40 is through an inlet 42 which is not blocked by the ball 38 if the ball 38 is to be used and landed against the ball sleeve 34. Pressure is built up in a cavity 44 which is sealed by seals 46, 48 and 50. Seals 48 and 50 are on the piston 26.

The latch mandrel 22 and the rest of the components which make up the plug P, as will be described below, have a variety of flowpaths therethrough. After the running tool 16 and the plug P are run into the wellbore W, as shown in FIG. 1 and 5A–5D, and positioned within the cased section 10 of the wellbore W, the plug P is inflated. This is accomplished by applying hydraulic pressure through an actuation flowpath 52 which communicates with a passage 54, as shown in FIGS. 5A–5B. The passage 54 extends longitudinally through a crossover 56. A separate, transverse circulation flowpath 58 provides access into the longitudinal extending portion of a circulation flowpath 60. The crossover 56 separates flowpaths 52 and 60.

Figures 6A, 6B, 6C, 6D:
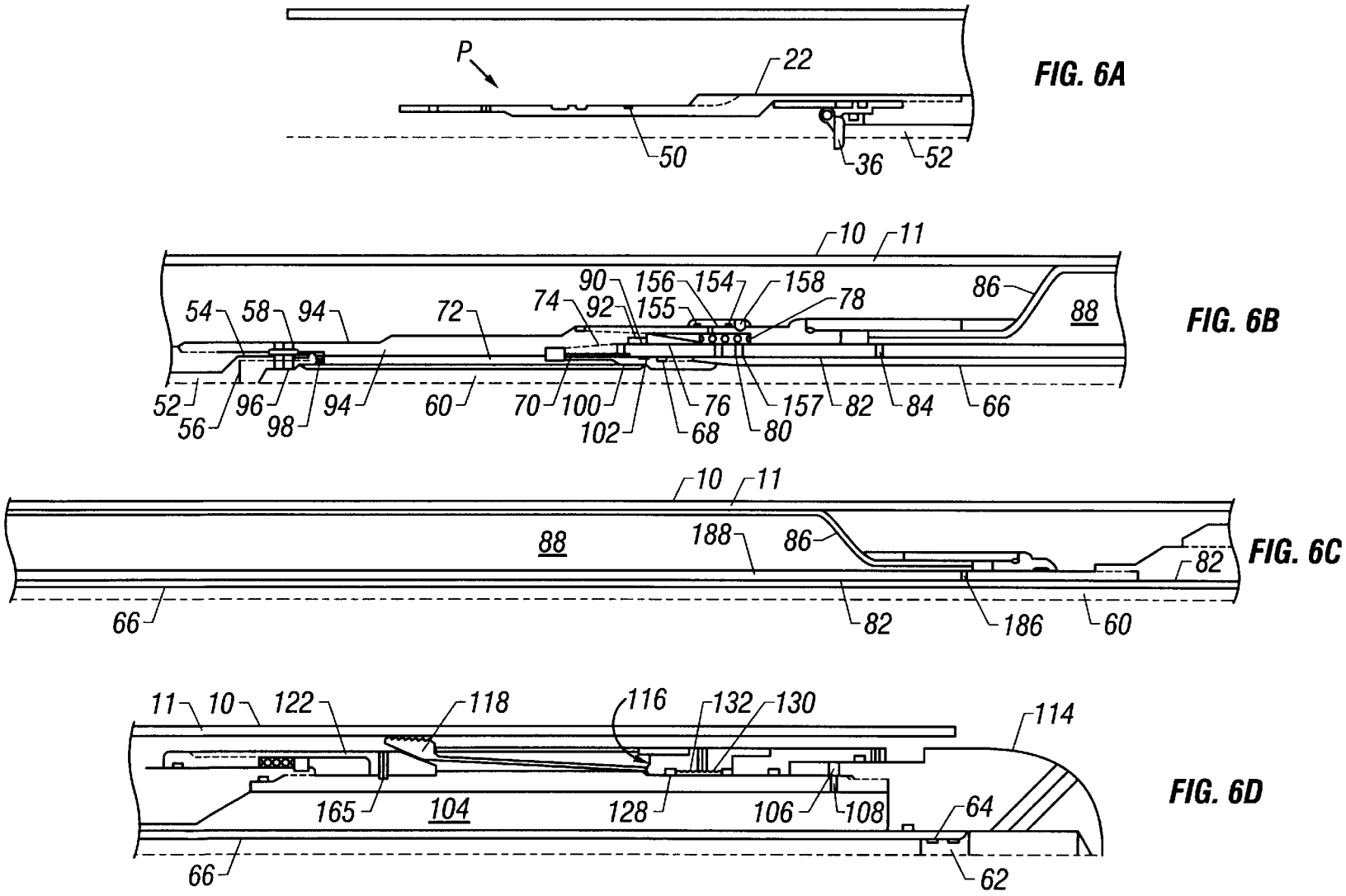
FIG. 6A–6D show the tool of FIG. 5, with the plug in the inflated position and the anchoring mechanism in a set position.

As shown in FIG. 5D, the flowpath 60 is initially obstructed with a stopper 62, which is secured by a shear pin 64 to an inner sleeve assembly 66. The inner sleeve assembly 66 is made up of several components, one of which is a connector 68 (FIG. 5B). The connector 68 has a series of transverse openings 70 which provide flow communication to an annular space 72 as shown in FIG. 6B. During the run-in position, shown in FIG. 5A–D, fluid pressure without the presence of the ball 38 is directed against the crossover 56 and then through the longitudinal flowpath 54 and ultimately into the annular space 72, which in turn communicates with openings 70. Fluid pressure through the openings 70 ultimately goes through openings 74 (FIG. 5B) where a poppet 76 is pushed against a spring 78. When a predetermined pressure has been exceeded and the poppet 76 is displaced, flow can proceed through openings 80 and through an annular passage 82. The poppet design is known in the art as a way to retain inflation pressure. The annular passage 82 communicates with a port 84 to allow inflation of the element 86 to take place by increasing the pressure and hence the volume of a cavity 88 (FIG. 6C). The poppet 76 has inner and outer seals 90 and 92 (FIG. 5B) which effectively prevent bypass flow around the poppet 76 until the poppet 76 is moved sufficiently to compress the spring 78 in response to flow of pressure where the outer seal 92 clears contact with a sleeve 94. The sleeve 94 is part of the outer portion of the body 188 of the plug P as shown in FIG. 5B. The sleeve 94 also has the transverse circulation flowpath 58 extending therethrough. It should be noted that seals 96 and 98 help separate the circulation flowpath 58 from the passage 54 which ultimately continues into the annular space 72. Seals 100 and 102 also help separate the annular flowpath 72 from the annular passage 82.

As the internal pressure in actuation flowpath 52 builds up, a cavity 104 (FIG. 6D), which is in fluid communication with the annular passage 82, also experiences a pressure buildup. The cavity 104 communicates with a cavity 106 through a port 108. In the run-in position shown in FIG. 5D, a shear pin 110 secures a ring 112 to a nose 114. The ring 112 is connected to a slip assembly 116. The slip assembly 116 includes a series of slips 118 with rough edges 120 which bite into the inside surface of the casing 11 of the cased portion 10 of the wellbore W, as shown in FIG. 6D. This is accomplished by using a cone 122 (FIG. 5D) with a sloping surface 124. The nose 114 is connected to an inner sleeve 126 which has a tooth pattern 128 on an outer side 127. The slip assembly 116 has a similar tooth pattern 130 with a different orientation. In between is a lock ring 132, which allows the slip assembly 116 to advance up or away from the nose 114 in response to a build up in pressure in the cavity 106, which ultimately breaks the shear pin 110. While the slips 118 are being set, the cone 122 is held to the sleeve 126 by a shear pin 165. The shear pin 165 ultimately is broken when it is time to release the set slips 118 as will be explained below. The structure of the slips 118 and the related structure around the cone 122 comprise the anchoring mechanism 123 for the plug P. The element 86 (FIG. 6B) is the sealing mechanism which isolates the upper zone U from the lower zone L, as shown in FIG. 2A, upon inflation.

At this point, the significant components in running and setting and releasing from the running tool 16 have been described. The sequence of events will now be reviewed to fully understand the operation of the plug P. As previously stated, coiled tubing 14 (FIG. 1) is used to run in the plug P in combination with the running tool 16. When the plug P is positioned in the desired location in the cased section 10 of the wellbore W, pressure is applied through the coiled tubing 14 and the running tool 16 into flowpath 52 (FIG. 6A). Eventually the pressure builds up to the point where the poppet 76 (FIG. 6B) is displaced against the spring 78. When that occurs, a flowpath is established from the passage 54 through the crossover 56 into the annular space 72, through openings 70 and 74, around the poppet 76, and through openings 80 into the annular passage 82. The element 86 is inflated through the port 84 against the casing 11, by increasing the volume of the cavity 88. Ultimately, additional pressure builds up to break the shear pin 110 (FIG. 5D). At that time the slip assembly 116 advances over the cone 122 and locks into position via the lock ring 132, as shown in FIG. 6D. With the element 86 set (FIG. 6B) and the slips 118 (FIG. 6D) secured against the cased portion 10 of the wellbore W, the pressure continues to build until the shear pin 24 (FIG. 5A) breaks. When that occurs, the piston 26, which is part of the running tool 16, moves downwardly, thus removing support for the collets 28. An upward pull on the coiled tubing 14 (FIG. 1), which is attached to a housing 136 (FIG. 5A), brings up the running tool 16, leaving behind only the latch mandrel 22 which is part of the body 188 of the plug P (shown in FIG. 6A). It should b-loaded flapper 36, which then springs downwardly as shown in FIG. 6A. In effect, the flowpath 52 is closed when the spring-loaded flapper 36 goes into its closed position, as shown in FIG. 6A. If for any reason the element 86 (FIG. 6B–6C) suffers a failure which could prevent pressure buildup to a sufficient level in the flowpath 52 to allow the running tool 16 to release from the latch mandrel 22, then the ball 38 (FIG. 5A) can be dropped to completely close off the flowpath 52 while leaving access through the inlet 42 to build pressure against the piston 26 for a release of the running tool 16 from the latch mandrel 22 in the manner previously described. It should also be noted that the inflated state of the element 86 (FIG. 6B–6C) is secured via the spring 78, which recloses the poppet 76 when the pressure is reduced in the coiled tubing 14 (FIG. 1). This occurs when the running tool 16 disengages from the latch mandrel 22. The pressure reduction seen in the flowpath 52 then allows the spring 78 to bias the poppet 76 back to the position shown in FIG. 6B to ensure the retention of the inflation pressure in the cavity 88 (FIG. 6C).

The lock ring 132, in effect, holds the slips 118 firmly against the cone 122, as shown in FIG. 6D. The plug P is now set and operations as illustrated previously in FIG. 3 can now take place without killing the well.

Figure 4:
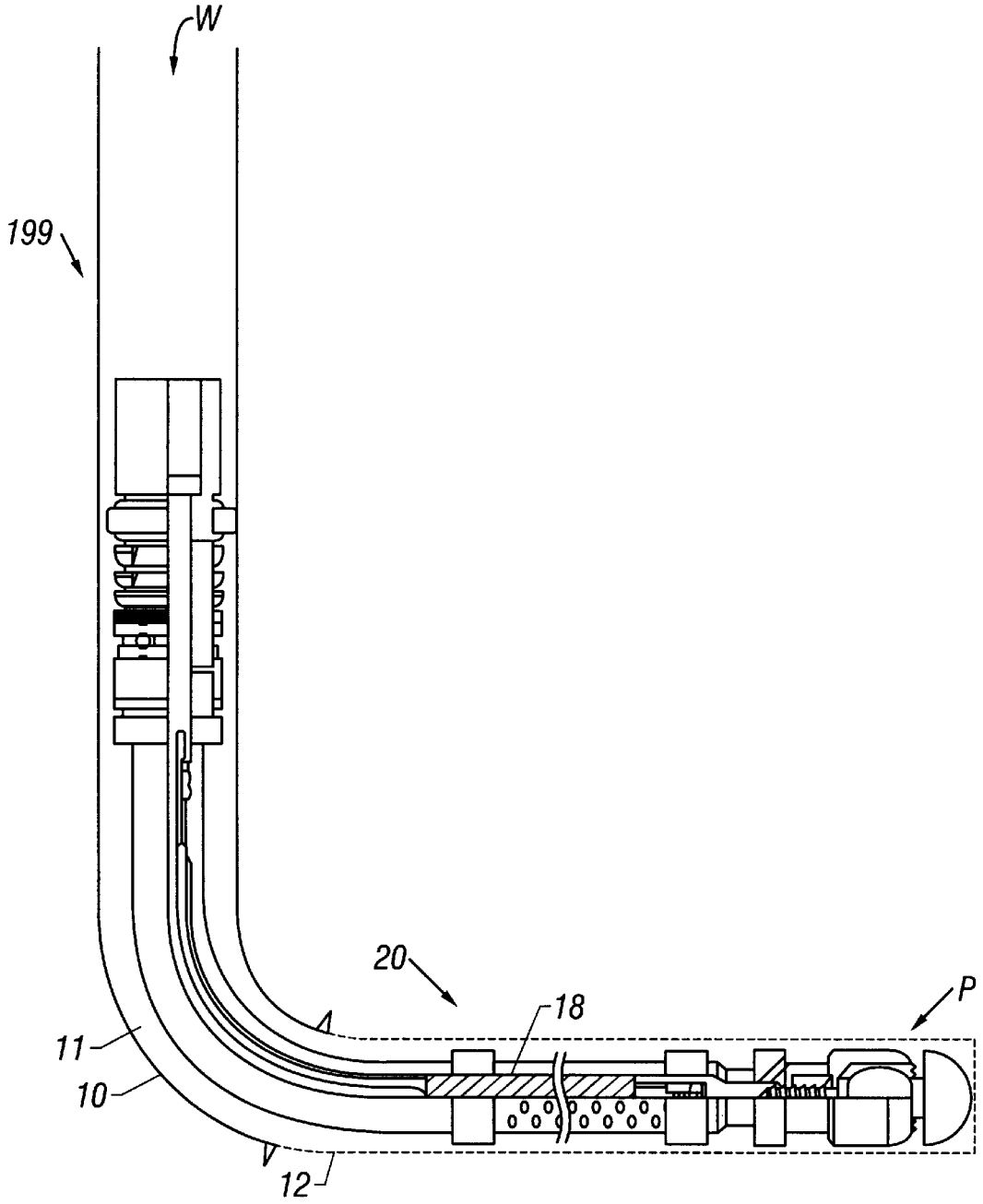
FIG. 4 illustrates the plug of FIG. 3 enveloped and pushed to the bottom of the open-hole portion of the wellbore.

The liner assembly 18 with the deflation tool 20 is run into position in the wellbore W as shown in FIG. 3 and FIG. 4. FIGS. 7A–7D illustrate the preferred deflation tool 20. The bottom of a liner 18 could also be configured to act as a deflation tool 20. The deflation tool 20 comprises an elongated sleeve 138 (FIG. 7A) with a lock ring 140 adjacent to the upper end of the sleeve 138. The lock ring 140 operates on a similar principal as the lock ring 132 (explained above) when the lock ring 140 ultimately engages a serrated surface 142 (FIG. 7B) on an upper deflation sleeve 144. The upper deflation sleeve 144 is connected to a lower deflation sleeve 146, which in turn is secured to the sleeve 138 of the deflation tool 20 by a shear pin 148. The upper deflation sleeve 144 has a taper 150, which ultimately engages a taper 152 on a sleeve 94. As the assembly of the sleeve 138 with the upper sleeve 144 and the lower sleeve 146 is advanced over the latch mandrel 22 (FIG. 7A), the lower sleeve 146 eventually contacts an outer sleeve 154 (FIG. 5B). The outer sleeve 154 sealingly spans over openings 156, using seals 155 and 157, and is initially held in that position by a shear pin 158. When the lower deflation sleeve 146 strikes over the sleeve 154, as shown in FIG. 7B, it breaks the shear pin 158, making the sleeve 154 translate downwardly. The pressure in the cavity 88 (FIG. 6C), which is holding the element 86 (FIG. 6B–6C) against the cased portion 10 of the wellbore W, can now be vented out through openings 84, back into the annular passage 82, back through openings 80 and out through openings 156. Accordingly, FIG. 7C shows the element 86 in the deflated condition with the slips 118 (FIG. 7D) still set. The lower deflation sleeve 146 now becomes trapped against the sleeve 94 due to a split ring 180 (FIG. 7B), as will be described below. Slips 118 remain set to support the body 188 of the plug P for the subsequent operations as will be described.

Figure 7B:
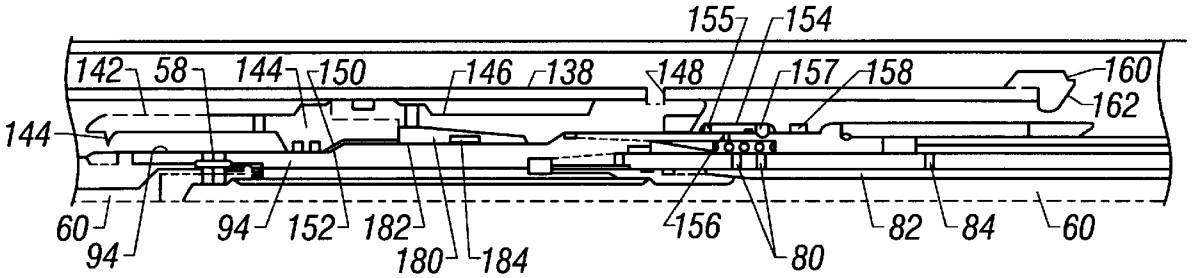
Figures 8A, 8B, 8C, 8D:
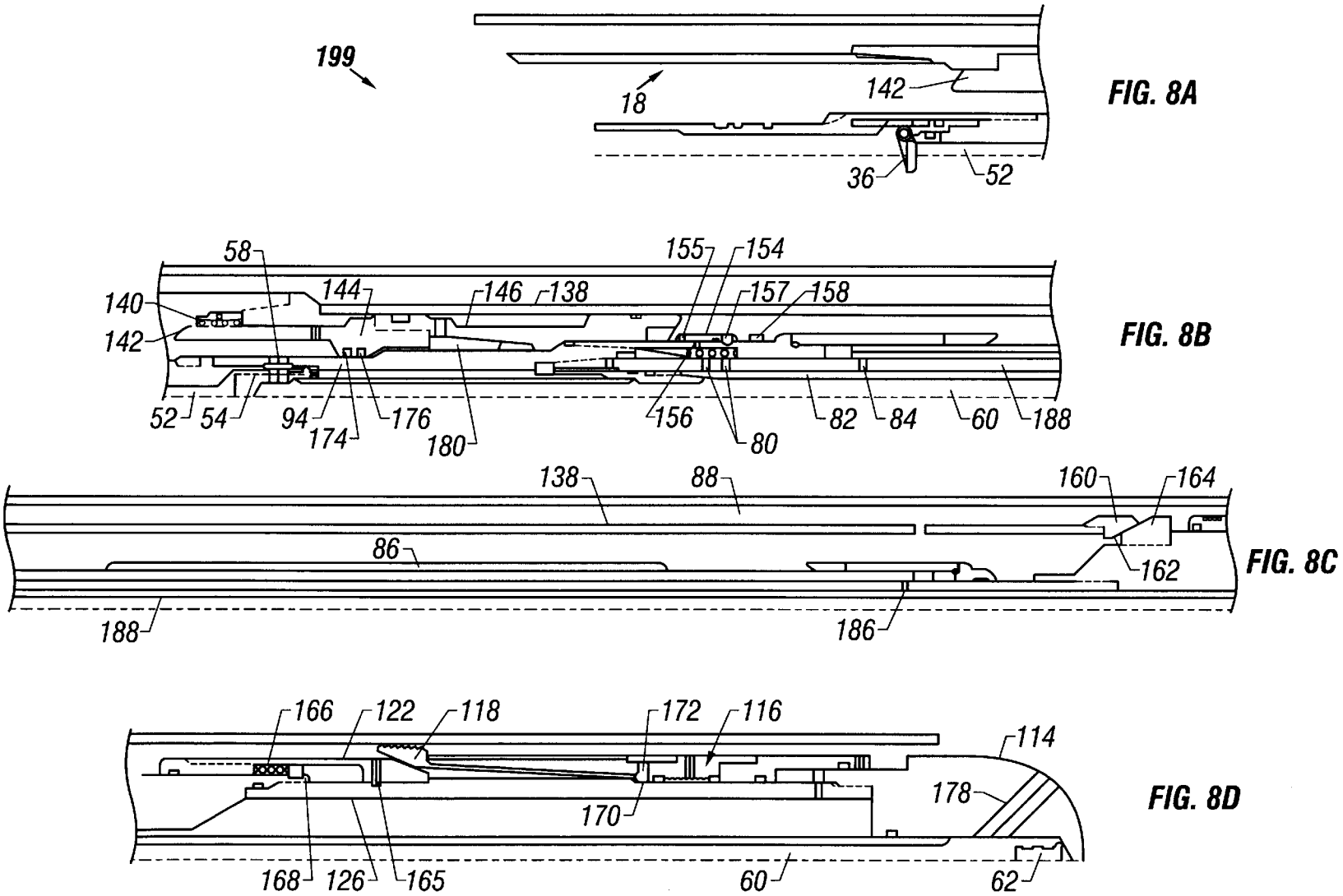
FIGS. 8A–8D are the view of FIGS. 7A–7D, illustrating the opening of the flowpath through the tool to allow circulation when the deflated tool is advanced toward the bottom of the open hole.
Figure 9A:
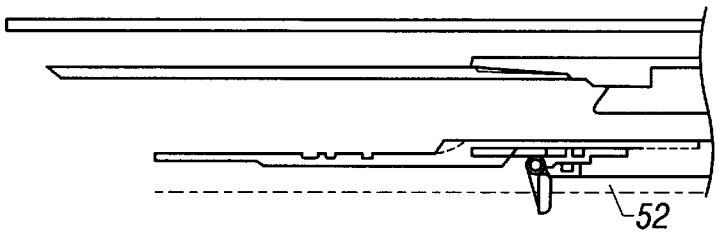
FIG. 9A–9D illustrate the release of the anchoring mechanism to allow the forward advance of the assembly with the deflation tool already having spanned over the deflated element as shown separately on FIGS. 8A–8D.
Figure 9B:
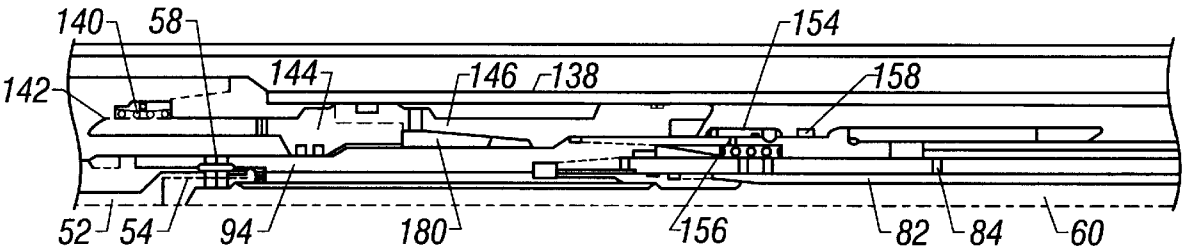
Figure 9C:
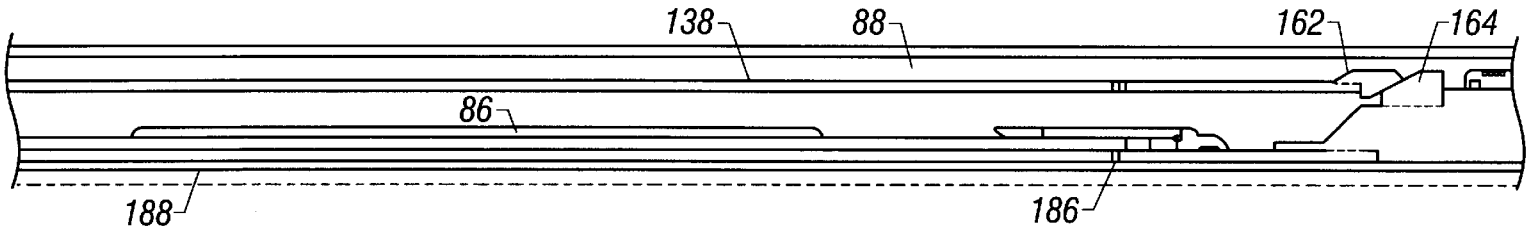
Figure 9D:
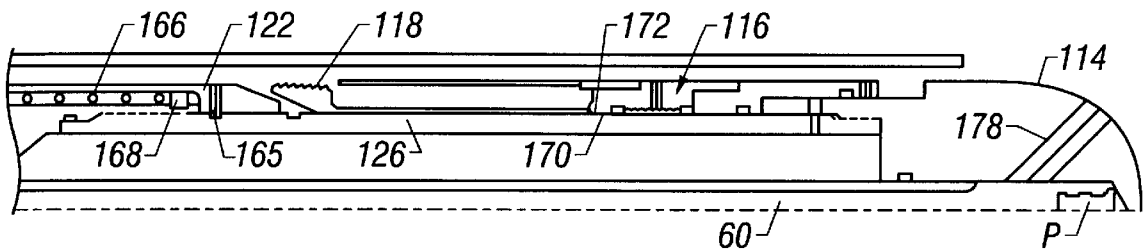

After deflation of the element 86 the next operation is to move the deflation tool 20 over the deflated element 86 with the tubularly shaped sleeve 138. To do this, weight is set down from the surface which ultimately breaks the shear pin 148 (FIG. 7B). When the shear pin 148 breaks, the sleeve 138 can advance as shown in comparison between FIG. 7B and 8B. A ring 160 sits at the bottom of the sleeve 138 and has a taper 162 which ultimately bottoms on a taper 164 as shown in FIG. 8C. Once the tapers 162 and 164 have made contact, weight can be applied to the sleeve 126 (FIG. 8D) through the sleeve 138. Application of weight to the sleeve 126 allows the shear pin 165 to break. When the shear pin 165 breaks, a spring 166 supported by a ring 168 drives the cone 122 upwardly, as shown by comparing the cone position in FIG. 8D with 9D. In FIG. 9D, the spring 166 has expanded, thus pulling the cone 122 out from under the slips 118. While this is happening, a shoulder 170 on sleeve 126 contacts a shoulder 172 on the slip assembly 116. Accordingly, setting down weight with tapers 162 and 164 in contact break the shear pin 165, to allow the spring 166 to pull the cone 122 out from under the slips 118, while at the same time downward movement of the sleeve 126 brings shoulders 170 and 172 together which pushes the slips 118 out from over the cone 122. The end result is that there is a release of the slips 118 to allow fuller progress of the liner assembly 18 such as is illustrated in FIG. 3, with the deflation tool 20 to carry the plug P forward to the bottom of the hole as shown in FIG. 4.

Figure 10:
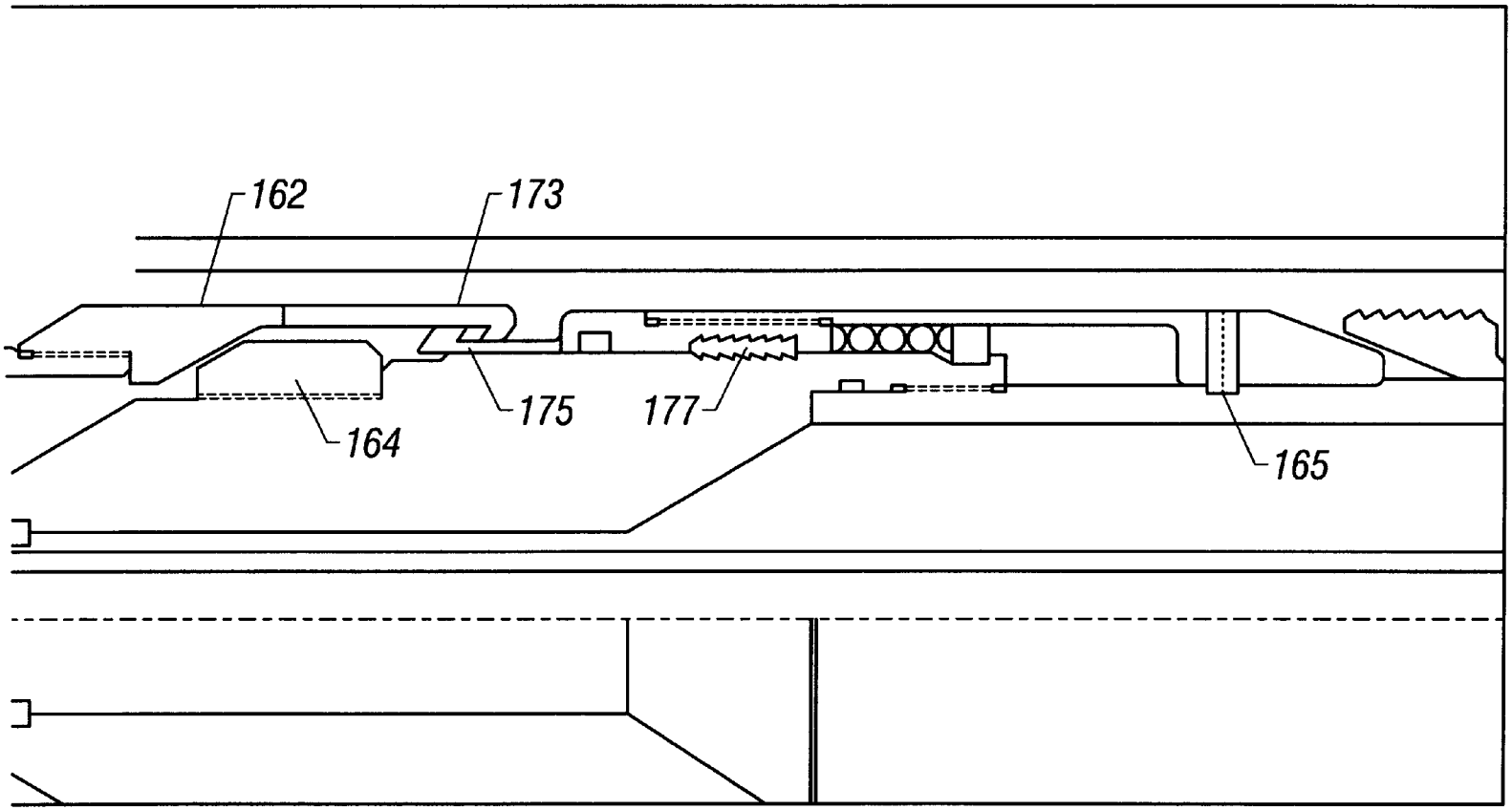
FIG. 10 is another embodiment showing release of the anchor assembly by moving the cone out from under the slip.

The deactivation tool D is bottomed on a guide ring. However, slacking off weight to release the anchor might not be available due to the use of a smaller workstring (like coiled tubing) used for releasing. FIG. 10 shows the preferred arrangement for use with a coiled tubing workstring. A latch 173 on the bottom of the deflation tool 20 engages a profile 175 on the top end of the cone assembly. Applying tension to the workstring after the latching as shown in FIG. 10 will now shear the screws in the cone, releasing the anchor slip. A body lock ring 177 can be added in the cone assembly to prevent any downward movement of the cone after release. After defeating the anchor, the assembly can be run into the openhole section.

To facilitate the advancement of the liner assembly 18 with the plug P, fluid pressure is applied through the deflation tool 20, which ultimately, through the flowpath 58, communicates with the plug P through the flowpath 60 as shown in FIG. 8B. Seals 174 and 176 facilitate the application of fluid pressure through the completion liner assembly 18 and the deflation tool 20 all the way down to the stopper 62 which is in the nose 114. Ultimately, the shear pin 64 (FIG. 6D) breaks and the stopper 62 is displaced beyond openings 178, which are generally oriented laterally of the rounded nose segment 114. Thus with the displacement of the stopper 62, the entire assembly 199 (FIG. 4) (the downhole tool 20 and the deflated plug P) can be advanced to the bottom of the uncased wellbore in the lower zone L with fluid circulation through openings 178. The rounded pr W during advancement of the assembly 199 downhole.

What has now been described is the tube or sleeve 138 advancing over the deflated element 86, with weight being set down to release the slips 118. However, prior to the release of the slips 118, it is important for the deflation tool 20 to grip the body 188 of the plug P so that when the slips 118 are released, the plug P is retained by the deflation tool 20 and does not drop downhole. To accomplish this, the split ring 180 (FIG. 7B) is supported between the upper deflation ring 144 and the lower deflation ring 146 as the deflation tool 20 is advanced. The split ring 180, which has internal teeth 182, is spread over the sleeve 94, which itself has a series of jagged teeth 184. As the sleeve 138 is advanced, the split ring 180 is forced open and into engaging contact with the sleeve 94 based on the interaction between teeth 182 and teeth 184. At this time the split ring 180 locks the deflation tool 20 to sleeve 94 because the split ring 180 cannot move up and it thereby traps the lower deflation sleeve 146. Ultimately, when the sleeve 138 of the deflation tool 20 is advanced forward after the shear pin 148 is broken, the lock ring 140 at the top of the sleeve 138 engages the serrated surface 142 on the upper deflation ring 144, and the position of the sleeve 138 shown in FIG. 8B is now fully locked in. When the split ring 180 effectively locks the lower deflation sleeve 146 to the sleeve 94, the operator at the surface knows that the element 86 should have deflated due to the displacement of outer sleeve 154. At that time the weight can be set down to move the sleeve 138 over the now-deflated element 86 and ultimately lock the sleeve 138 into position with the lock ring 140.

As shown in FIG. 6C, there is a vent port 186 toward the lower end of the element 86. The vent port 186 is in fluid communication with the annular passage 82 such that when the outer sleeve 154 is pushed over, thus exposing openings 156 (FIG. 6B), the element 86 can deflate by venting pressure at its upper end through ports 84 as well as through the lower end through openings or ports 186. This helps to ensure that the element 86 is fully deflated with minimal trapped fluid due to elimination of pockets so that the sleeve 138 of the deflation tool 20 can move over element 86 smoothly without snagging.

As shown in FIG. 8B, the split ring 180 secures the assembly of the upper deflation sleeve 144 and the lower deflation sleeve 146 to the sleeve 94, such that when pressure is applied through the flowpath 58 to displace the stopper 62 (FIG. 8D), the deflation tool 20 is firmly anchored to the plug P. As previously stated, the position of the sleeve 138 when it washes over the element 86 is secured to the serrated surface 142 on the upper deflation sleeve 144. With the sleeve 138 secured through the use of the lock ring 140, the overall structure gains significantly in rigidity. For example, the sleeve 138 can be made of 7"casing while the body 188 of the plug P can be in the order of 2⅞" which is considerably more flexible. The additional strength delivered by moving down the sleeve 138 prevents sag in the assembly over its length. The more rigid the assembly (the completion liner 18 in combination with the deflation tool 20 spanning over plug P, as shown in FIG. 4), the less likely it is that the entire assembly upon advancement downhole will sink into washed out sections in the uncased portions of the wellbore W. FIG. 4 illustrates an area of washout 190 in the uncased portion of the wellbore W. When washouts occur and an attempt is made to advance the assembly as shown in FIG. 4, the lack of longitudinal rigidity causes the front end to sag into the washed out portion. If the leading end of the liner assembly 18 is too flexible, it can easily be caught in the washout 190. To reduce this possibility, the nose 114 is rounded to help it over or out of small washouts. It is more important, however, that the additional structural rigidity (created in the assembly after the sleeve 138 is brought over the deflated element 86) ensures that the sag is kept to a minimum and that the assembly can advance, even over a washed out segment, by merely keeping true to its line of travel without sagging into washouts in the uncased portions of the wellbore W. The structure is akin to a cantilevered beam which can sag at its free end if it is not sufficiently rigid.

The assembly of the slips 118, as previously described, provides additional support of the plug P when the element 86 is inflated. Additionally, it provides continuing support for the body 188 of the plug P when the element 86 is deflated. This additional continuing support after deflation helps to make it possible to advance the sleeve 138 over the deflated element 86 to increase the longitudinal rigidity and thus minimize sag in the assembly upon subsequent advancement. The design also features a flowpath all the way to the nose 114 through outlets 178 so that circulation can be maintained while the assemblies advance as shown in FIG. 4. Circulation while advancing facilitates the advancement of the assembly to the position shown in FIG. 4.

Proper deflation of the element 86 is more likely in view of the vent ports 84 (FIG. 6B) and 186 (FIG. 6C) at the upper and lower ends of the cavity 88, respectively. With the deflation occurring through ports 84 and 186, the likelihood of trapped fluid within the cavity 88 when outer sleeve 154 is displaced is greatly reduced. That means the sleeve 138 can then more dependably go over the deflated element 86 at a time when the element is fully deflated and will not impede the progress of the advancing sleeve 138.

Figure 7A:
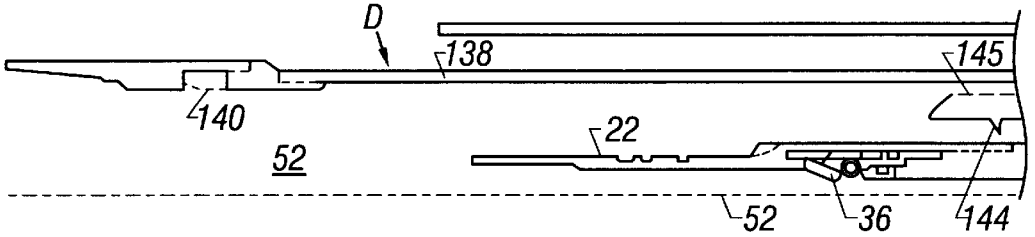
FIGS. 7A–7D illustrate the insertion of the deflation tool with the inflatable element in a deflated condition and prior to release of the anchor.
Figure 7C:
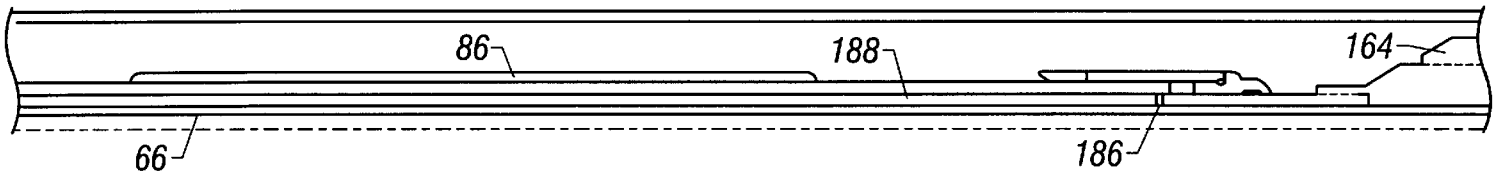
Figure 7D:
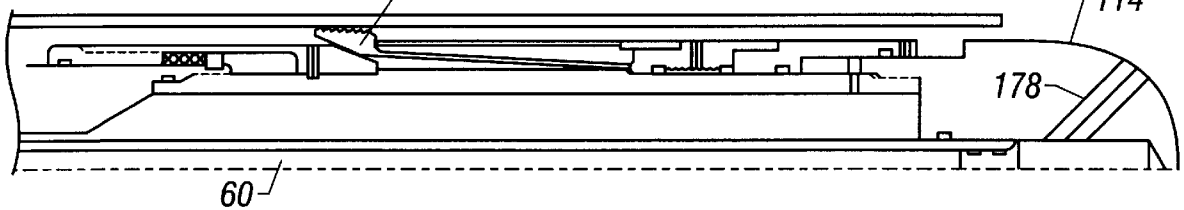

The spring-loaded flapper 36 covers over the passage 52 after removal of the running tool 16, as shown in FIG. 7A. In that position, pressure directed through the completion liner assembly 18, when fully latched to the plug P as shown in FIGS. 8A–8B, will force any pressure through the flowpath 58 for initially breaking loose the stopper 62, thus clearing the flowpath 178 and the nose 114. With the spring loaded valve 36 in the closed position, the passage 54 (FIG. 8B) is closed off so that applied pressure within the completion liner assembly 18 cannot communicate with the flowpath 52 or the passage 54.

When the completion liner assembly 18 is advanced to the position shown in FIG. 4, production in the known manner can begin from the uncased portion of the wellbore W.

While the preferred embodiment comprises the sleeve 138 coming over the plug P, stiffening the plug P or other downhole tool in other ways is a part of the invention. The sleeve 138 can be of differing construction and can cover all or part of the plug P. The plug P can be stiffened after deflation by adding rigidity to its body, internally as opposed to externally, using the sleeve 138 or by other equivalent techniques.

Figure 11B:
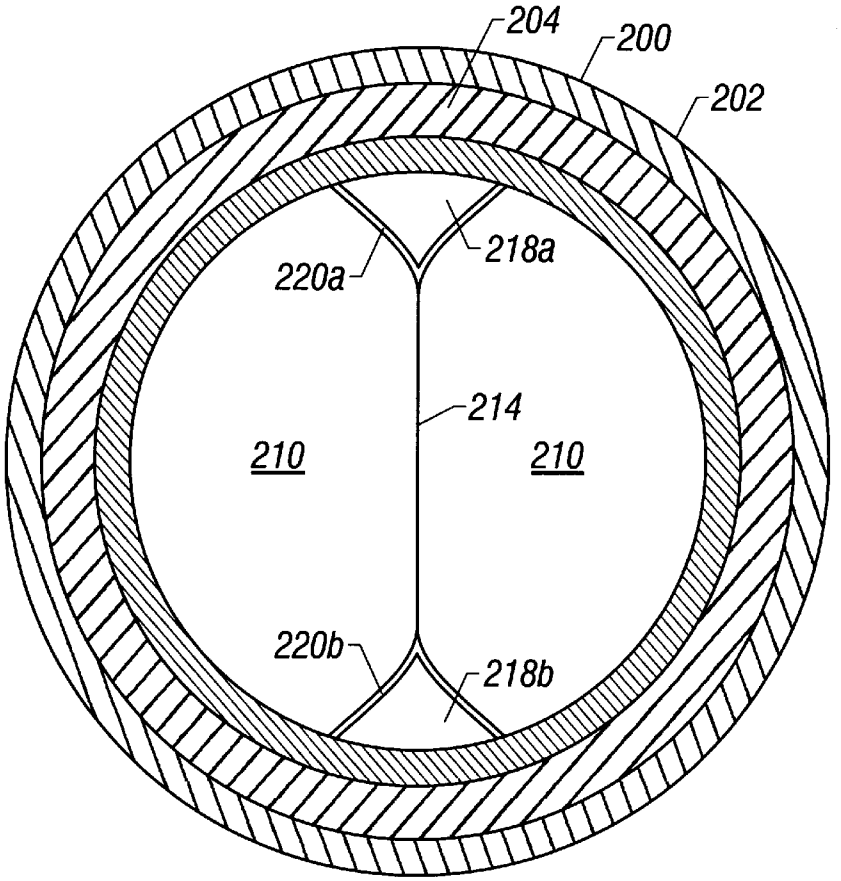
FIG. 11B is a cross-sectional top view of the swab valve of FIG. 11A.
Figure 11A:
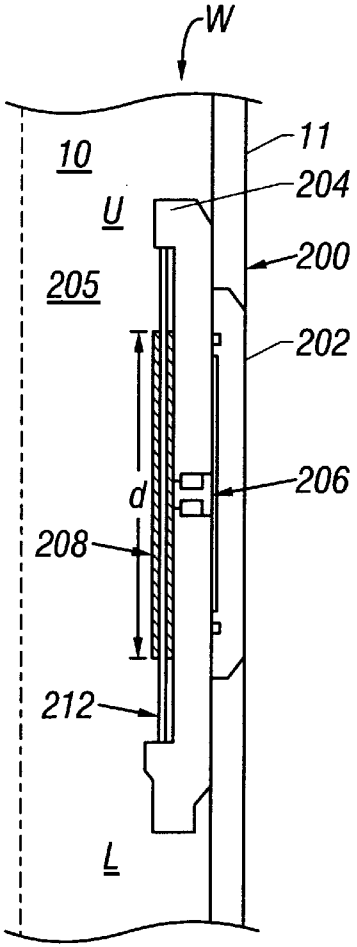
FIG. 11A is a side view of another preferred embodiment showing an inflatable swab valve.

A second preferred embodiment the sealing device 250 is shown in FIG. 11A–11B. This device 250 includes an internally inflatable seal member (swab or plug) 200 and an anchor mechanism 202. The device 250 may be designed to be fitted into the casing before it is deployed in the wellbore to form the cased section or retrievabley installed in an existing wellbore as described below. FIGS. 11A–11B show the device 250 installed in the casing 11. The swab valve or plug 200 is fitted into the casing 11 before the casing 11 is positioned within the wellbore W to form the cased section 10, as shown in the partial cross-sectional side view of FIG. 11A. The plug 200 has an outer sleeve 202 which is the anchoring mechanism 123 that holds the valve 200 in position within the wellbore W and the conduit for the transmission of inflating medium (not shown), such as hydraulic oil or wellbore fluid. The outer sleeve 202 is attached to an inner sleeve 204 having an inflation port and check valve 206 that provides a passageway between the outer sleeve 202 and a flexible element 208 fitted to the inside of the inner sleeve 204.

The purpose of the element 208 is to seal the upper zone U of the wellbore W from the lower zone L similar to the element 86 of the inflatable bridge plug P described above, although the operation is different. The swab valve has a through opening 205 which is sufficiently large to allow the passage therethrough of the desired completion string. Instead of having a single element that expands outwardly to form a seal as described above, the inflatable swab valve 200 has two or more inflatable membranes 210 which expand from the inside of the inner sleeve 204 towards the center of the swab valve 200 or the wellbore axis.

As pressure is applied to the inflatable membranes 210 via the valve 206, the membranes 210 expand to fill the inside area 205 of the swab valve 200, as shown in FIG. 11B. The membranes 210 urge against each other at a juncture or intersection 214 along the length d of the flexible member 208. This however leaves axial areas 220*a* and 220*b* through which fluid may leak between the upper (U) and lower (L) wellbore sections. Compliant spacers or seal guides 218*a* and 218*b* having suitable sealing profiles and preferably made from a stiff material such as steel are disposed along the length of segments 218*a* and 218*b* respectively. When the membranes 210 are expanded or inflated, they sealingly urge against each other along the intersection 214 and also against each the compliant spacers 220*a* and 220*b*, thereby completely sealing the upper (U) and lower (L) sections of the wellbore W. After obtaining the desired seal, the pressure is locked in place, effectively sealing the wellbore W into the desired upper and lower zones U and L, respectively. Pressure can then be applied using an inflation tool (not shown) run in to the bore of the tool (not shown) or, alternatively, via a control line run down the outside of the coiled tubing 14 above the tool. Other methods could also be used to control the tool. Ribs 212, as shown in FIG. 11A, could be fitted within the inner sleeve 204 of the inflatable swab valve 200 to operate with the membranes 210 to provide additional strength to the membranes 210 after inflation.

Alternatively, the anchor mechanism 202 may be designed so that the swab valve 200 may be conveyed in the wellbore W and installed in place at a desired location. A mechanism also is provided to unlatch and retrieve the swab 200 from within the wellbore also is provided. Such anchoring mechanisms and retrieving devices are known in the art and are thus not described herein. An advantage of the retrievable device is that it can be installed in preexisting casings and may be reused. An advantage of the swab valve that is preinstalled installed in the casing 11 is that it can be integrated into the casing 11 at the surface, which can be a relatively simple operation and avoids a trip into the wellbore.

In either types of the configurations of the swab valve 200, it is set in the wellbore at a suitable location. The inflatable seal membranes are inflated to isolate the upper and lower sections of the wellbore W, which leaves the upper section U at a relatively low pressure. The desired tool string, such as tool string 18 of FIG. 3 carried by a wireline or a coiled tubing is then run into the upper section U. A seal is maintained around the wireline or the coiled tubing as is commonly known in the art. The tool string then deflates membranes 210, which collapse to their initial position as shown in FIG. 11A. The tool string is then moved through the opening 205 to a desired location in the lower section L to perform the desired operation. This preferred embodiment of the inflatable swab valve 200 can be used for the deployment of tools (such as drilling BHAs, slotted liners, screens and perforating guns, for example) in a live well for underbalanced application.

The foregoing disclosure and description of the invention are illustrative and explanatory thereof, and various changes in the size, shape and materials, as well as in the details of the illustrated construction, might be made without departing from the spirit of the invention.

What is claimed is:

1. A method for avoiding formation impairment in the completion of a wellbore extending down to a hydrocarbon bearing reservoir, comprising:

providing a plug having a through axial opening, said plug having a seal member selectively operable between a first mode in which fluid is free to flow in the wellbore through the plug opening and a second mode in which the seal member encloses the plug opening thereby blocking fluid flow past the plug and an anchor for affixedly securing the plug in position in the wellbore;

positioning the plug while in its first seal member mode and its first anchor mode at a predetermined position in the wellbore above the hydrocarbon bearing reservoir; and actuating the plug to move the seal member to its second mode blocking fluid flow in the wellbore past the plug and to move the anchor to its second mode securing the plug in the wellbore, whereby the zone of wellbore associated with the hydrocarbon bearing reservoir is isolated from the remainder of the wellbore.

2. The method of claim 1, wherein the seal member is an inflatable member and the step of actuating the plug to move the seal member to its second mode comprises supplying fluid under pressure to the seal member.

3. The method of claim 2 wherein the step of moving the seal member back to its first mode comprises deflating the seal member with a deflation tool.

4. The method of claim 1 further comprising anchoring the plug in a casing before installing said casing in the wellbore.

5. A plug for use in a wellbore during completion of a well, comprising:

a body;

a seal member attached to the body and selectively operable between a first mode in which fluid is free to flow in the wellbore past the plug and a second mode blocking fluid flow past the plug; and an anchor associated with the body independently operable of the seal member between a first mode in which the plug is movable within the wellbore and a second mode affixedly securing the plug in position in the wellbore.

6. The plug of claim 5, wherein the seal member is an inflatable member.

7. The plug of claim 6, wherein the seal member operates in conjunction with a deflation tool to move the seal member from its second mode to its first mode.

8. The plug of claim 5, wherein the plug further comprises fluids extending through a passageway in the plug and a valve in the passageway operable between a first closed mode blocking fluid flow through the plug and a second open mode enabling fluid flow through the plug.

9. The plug of claim 5, wherein the plug further comprises a sleeve for covering the seal member when positioning the plug in the wellbore.

10. The plug of claim 5, wherein the plug is detachably connected to tubing for positioning the plug in the wellbore.

11. The plug of claim 5, wherein the plug is used in combination with a deflation tool insertable in the wellbore and contacting the body to initially deflate the inflatable member and then to advance over at least a portion of the deflated member while the body remains supported in the wellbore by the anchor.

12. A plug for use during an operation in an underbalanced wellbore, comprising:

(a) a through opening that allows the passage of a fluid therethrough;

(b) an anchor for anchoring the plug in the wellbore;

(c) a seal members selectively operable between a first position in which fluid is free to flow in the wellbore past the plug and a second position in which the seal member sealingly closes the through opening in the seal member, thereby blocking fluid flow past the plug.

13. The plug of claim 12, wherein the seal member further comprising at least two expandable flexible elements that expand to close the opening in the plug.

14. The plug of claim 13, wherein each expandable flexible element further comprises ribs that operate in conjunction with the expandable flexible member to provide additional strength when the seal member is in the second mode.

15. A method for avoiding formation impairment in the completion of a wellbore extending down to a hydrocarbon bearing reservoir, comprising:

providing a plug having a seal member selectively operable between a first mode in which fluid is free to flow in the wellbore past the plug and a second mode blocking fluid flow past the plug, and an anchor independently operable of the seal member between a first mode in which the plug is movable in the wellbore and a second mode affixedly securing the plug in position in the wellbore;

positioning the plug while in its first seal member mode and its first anchor mode at a predetermined position in the wellbore above the hydrocarbon bearing reservoir; and actuating the plug to move the seal member to its second mode blocking fluid flow in the wellbore past the plug and to move the anchor to its second mode securing the plug in the wellbore, whereby the zone of wellbore associated with the hydrocarbon bearing reservoir is isolated from the remainder of the wellbore.

16. The method of claim 15, wherein the seal member is an inflatable member and the step of actuating the plug to move the seal member to its second mode comprises supplying fluid under pressure to the seal member.

17. The method of claim 16 wherein the step of moving the seal member back to its first mode comprises deflating the seal member with a deflation tool.

18. The method of claim 17 further comprising engulfing the plug within the deflation tool, wherein the combination of the plug and the deflation tool provides more rigidity to the deflation tool thereby lessening hangups of the deflation tool in washouts in the wellbore during the movement of the deflation tool downhole.

19. The method of claim 15 further comprising selectively dislodging the plug from the wellbore by moving the seal member back to its first mode of operation and moving the anchor back to its first mode of operation, thereby releasing the plug for movement within the wellbore.

20. The method of claim 19 further comprising repositioning the plug toward the end of the hydrocarbon bearing reservoir.

21. The method of claim 19 wherein the plug further comprises fluids extending through a passageway in the plug and a valve in the passageway operable between a first closed mode blocking fluid flow through the plug and a second open mode enabling fluid flow through the plug; and wherein the method further comprises moving the valve to its second open position and flowing circulation fluid through the passageway when repositioning the plug in the wellbore.

22. The method of claim 19 further comprising providing tubing for conveying the plug to selected positions in the wellbore.

23. The method of claim 19 further comprising detachably securing the plug to tubing when the plug is being moved and releasing the plug from the tubing when secured in position.

* * * * *